US005996210A

United States Patent [19]

König

[11] Patent Number: 5,996,210

[45] Date of Patent: Dec. 7, 1999

[54] METHOD OF PRODUCING A FLAT COMMUTATOR

[75] Inventor: Eckhard König, Ehningen, Germany

[73] Assignee: Kautt & Bux Commutator GmbH, Herrenbert, Germany

[21] Appl. No.: 08/973,989

[22] PCT Filed: Jan. 30, 1997

[86] PCT No.: PCT/EP96/02706

§ 371 Date: Mar. 30, 1998

§ 102(e) Date: Mar. 30, 1998

[87] PCT Pub. No.: WO97/03486

PCT Pub. Date: Jan. 30, 1997

[30] Foreign Application Priority Data

Jul. 13, 1995 [DE] Germany ..... 195 25 584

[51] Int. Cl.[6] ..... H01R 43/08

[52] U.S. Cl. ..... 29/597; 310/235; 310/237

[58] Field of Search ..... 29/597; 310/235–237

[56] References Cited

U.S. PATENT DOCUMENTS 3,478,421 11/1969 Preece ..... 29/597
4,035,908 7/1977 Ishi et al. ..... 29/597
4,283,841 8/1981 Kamiyama .
4,358,319 11/1982 Yoshida et al. .
5,157,299 10/1992 Gerlach .
5,245,240 9/1993 Takasaki .
5,400,496 3/1995 Kemmner et al. ..... 29/597

OTHER PUBLICATIONS

International Search Report for PCT/EP96/02706.

*Primary Examiner*—Carl E. Hall
*Attorney, Agent, or Firm*—Blank Rome Comisky & McCauley LLP

[57] ABSTRACT

A method of manufacturing a flat commutator comprising the steps of providing a support member having segment carrier parts; forming identical grooves in one side of said support member extending radially from the center of the support member, moulding a hub around the grooved support member with moulding compound entering the grooves; reducing the thickness of the support member from the ungrooved or abutment side of the support member until the support member is divided into a plurality of electrically isolated segment carrier parts with the moulding compound exposed in each groove; bonding an annular disc of carbon to the segment carrier parts and dividing said disc into a plurality of commutator segments.

7 Claims, 3 Drawing Sheets

METHOD OF PRODUCING A FLAT COMMUTATOR

BACKGROUND OF THE INVENTION

The invention concerns a process for manufacturing a flat commutator.

When a commutator is used in an environment that is aggressive for copper, for example, in a fuel containing methanol for motor vehicles, it is customary to designate carbon as the material for the commutator segments. These carbon segments must, however, be supported by segment supporting structures made of copper to be able to connect the coil ends of the rotor coil with the segments without a problem.

A process for manufacturing a carbon flat commutator is already known (DE 40 28 420 A1), which yields a commutator in which all the areas of the existing support body that are made of copper except the connecting hook are completely covered by the carbon segments and the molded plastic material. Therefore this commutator satisfies the highest demands. But its production is relatively expensive.

A known process of the type mentioned at the outset U.S. Pat. No. 5,255,426 is considerably more cost effective; in this process the ring wheel, which is made of carbon, is soldered on the segment supports after forming the hub on the support body, and then both the ring wheel and the support body are segmented by separating cuts. A disadvantage with this commutator is, however, that the cut edges of the support body, i.e., the lateral faces of the copper segment support parts, which border on the air gap, are exposed.

The problem of the invention is, therefore, to designate a process for manufacturing a flat commutator of the type mentioned that yields a commutator that is free of every disadvantage, but can still be designed inexpensively.

SUMMARY OF THE INVENTION

By virtue of the fact that the thickness of the support body is reduced until it results in the complete separation of the segment supporting structures from each other before the ring wheel is connected to the segment supporting structures, the separating cuts—through which the ring wheel is segmented—only need to separate the ring wheel. In addition, because the material parts of the molded plastic material, which fill in the grooves provided in the supporting body, have a larger width than the air gap formed when the ring wheel is segmented, these air gaps are connected to the molded plastic material between the segment supporting structures so the latter are not exposed by the separating cuts.

In a preferred working form the thickness reduction takes place by turning in the lathe. In so doing a centering bush for the ring wheel, which projects over the contact surface for the ring wheel, is formed advantageously from the material part of the molded plastic material covering the area of contact of the central bore—which contributes to a reduction of the production costs.

To be able to solder the ring wheel, which is made of carbon, to the segment supporting structures, it is necessary to metallize the side of the ring wheel turned toward the solder layer. Usually, in that connection, a thin copper layer is deposited by vapor. To avoid bringing this thin copper layer into contact with the aggressive environment of the commutator because it is exposed in the air gap, a silver layer instead of a copper layer is vapor or, deposited a silver layer is electroplated after depositing the copper layer.

Likewise, the contact surface of the segment supporting structures is coated with a thin silver layer. As long uses silver solder is used, all contact between the aggressive environment and the copper forming the supporting part is ruled out.

BRIEF DESCRIPTION OF THE DRAWINGS

The invention is illustrated below in greater detail with the use of two working examples represented in the drawings.

DETAILED DESCRIPTION OF THE PREFERRED

Figure 1:
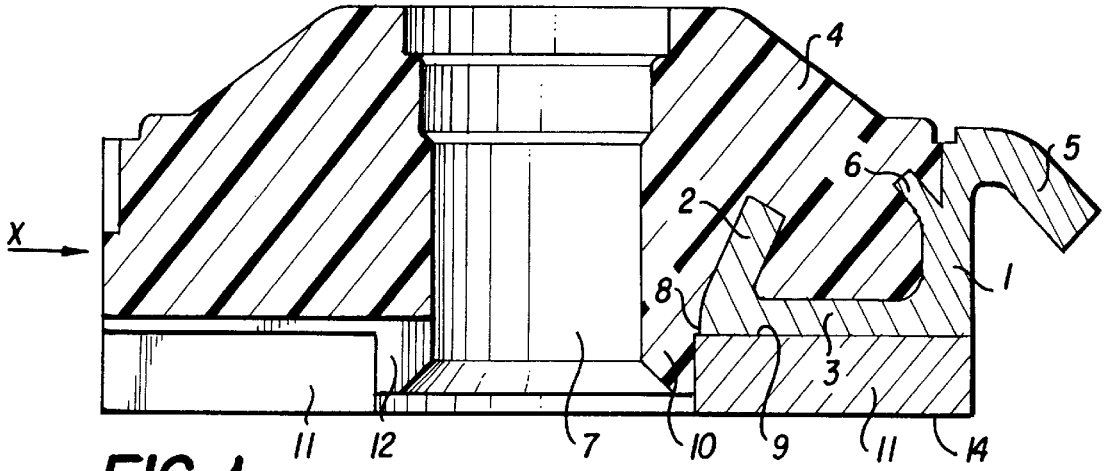
FIG. 1 shows a longitudinal cut of a first working example.

A plate bar is punched out of a copper flat belt or something similar to manufacture a supporting body; the plate bar has the shape of a annular disk from whose outer edge tongues 1 project radially and are distributed at intervals from one another evenly over the circumference. The number of tongues is chosen to equal the number of segments of the flat commutator that is to be manufactured. In the circular central opening of the annular disk a number of fingers 2 corresponding to the number of tongues 1 project in radial direction; these fingers 2, like the tongues 1, are separated from each other and are distributed evenly over the circumference in the same angular position as the tongues 1. Each of the tongues 1 and one of the fingers 2 is assigned to one of the segment supporting structures 3, to be formed from the annular disk, in such a way that the plane of symmetry of the tongue 1 and the fingers 2 lie in the plane of symmetry of the segment 3.

When being punched, grooves 3' are imprinted on each side of the circular ring wheel on which a hub 4 of molded plastic material is later formed (in the working example by extrusion molding); these grooves extend in radial direction from the inner to the outer edge of the annular disk and separate the segment supporting structures from each other in the finished commutator. The depth of the grooves 3' is chosen so that the bars 3" forming the groove foundation are as thin as possible, but at first hold the segment supporting structures 3 in the plane determined by the annular disk.

In a process that follows, by forming changing elements of a cylindrical bush, the tongues 1 are bent 90° with respect to the segment supporting structures 3, which are designed as one piece with the changing elements. In addition, the hook elements 5, which at first project centrally in radial direction from the free end of each tongue 1, are bent in the opposite direction by more than 90° so that they, as FIG. 1 shows, each form a hook for the connection of the rotor coil in the finished commutator.

The fingers 2 are also bent more than 90°, but in the same direction as the tongues 1, for the formation of anchoring elements. Finally, anchoring elements 6, which form an acute angle with the tongue 1, are split off from the inner side of each bent finger 2, as FIG. 1 also shows.

Figure 2:
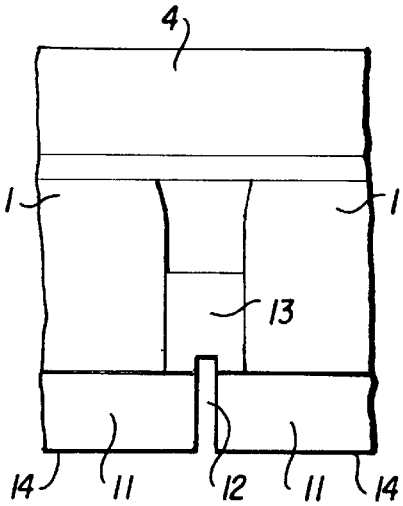
FIG. 2 shows an incompletely represented top view of the surface shell of a first working example in the direction of arrow X of FIG. 1.
Figure 6:
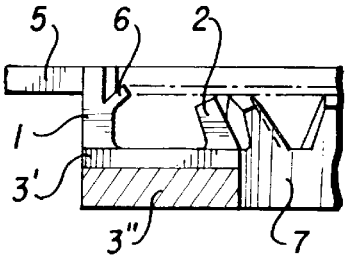
FIG. 6 shows a cut according to line VI—VI of FIG. 5.

Then the hub 4, which is made of molded plastic material, is formed on the side of the supporting body towards which the grooves are open. The hub 4 has a hub bore 7, which has steps in the working example and whose smallest diameter is in the area of the segment supporting structure 3, which, as FIG. 1 shows, is clearly smaller than the diameter of the area of contact 8 of the central opening of the supporting body. The area of contact 8 is therefore completely covered by the plastic molded material, which forms the hub 4. As FIG. 1 shows, the hub 4 extends in axial direction beyond the RING ZONE defined by the area of contact 8. FIG. 2 shows, in addition, that the plastic molded material forming hub 4 completely fills in the grooves between the segment supporting structures 3 with a material part 13 each.

Then the supporting body is turned on a lathe on the side turned away from the hub 4 until the bars 3" between the segment supporting structures 3 are completely removed and the plastic molded material filling the grooves is completely free towards the processed surface 9. During the processing a centering bush 10 is formed from the end section protruding in axial direction over the supporting body; the centering bush projects over the surface being processed 9 in axial direction and has an outer diameter which is a little smaller than the inner diameter of the area of contact 8.

With an intermediate layer of a silver solder layer 17 a pressed ring wheel made of carbon, whose inner diameter matches the outer diameter of the centering bush, is then placed on the surface being processed 9. Before this the ring wheel 11 was metallized on the side turned toward the solder layer, that is, in the working example by depositing copper by vapor. Then the ring wheel 11 is soldered on the contact surfaces of the segment supporting structures 3, formed by the surface being processed 9.

After that the ring wheel is separated by radial cuts into commutator segments 11. As FIG. 2 shows, the width of the cuts, through which the air gaps 12 are formed between the commutator segments 11, are considerably smaller than the width of the material parts 13 of the molded plastic material, which have first filled in the existing grooves of the supporting body and then are exposed when turning the supporting body on the lathe. Moreover, FIG. 2 shows that the separating cuts are aligned in the middle of the material parts 13 and penetrate them a little bit.

In the end, the exposed side of the commutator segments 11, which form the brush running surface 14, are turned a little to be certain that the brush running surface 14 is smooth and lies in a radial plane of the commutator.

After the commutator is attached to the shaft of a motor and the rotor coil has been connected to the hook elements 5 so it is mechanically solid and electrically conductive, preferably by welding, the commutator is embedded on its circumference in plastic, which covers the outer side of the tongues 1 completely and preferably also a bordering ring zone of the commutator segments 11 and the hook elements 5. The segment supporting structures 3 including the hook elements 5 are therefore protected from aggressive substances, which is the reason why the commutator can also be used, for instance, for the driving motor of a fuel pump, whose commutator comes into contact with the fuel, which also contains methanol.

Figure 3:
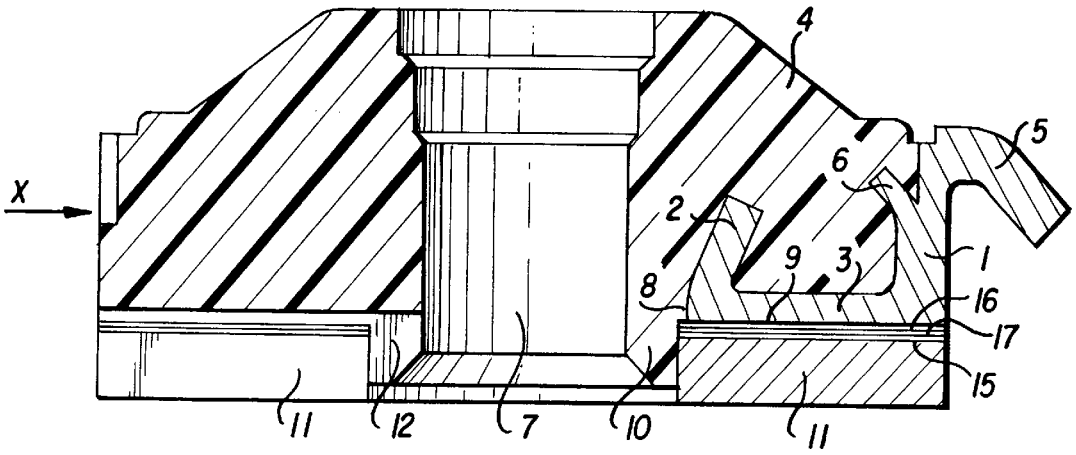
FIG. 3 shows a longitudinal cut of a second working example with metal layers that are greatly enlarged in the area of the connection between the carbon segments and the segment supporting structures.
Figure 4:
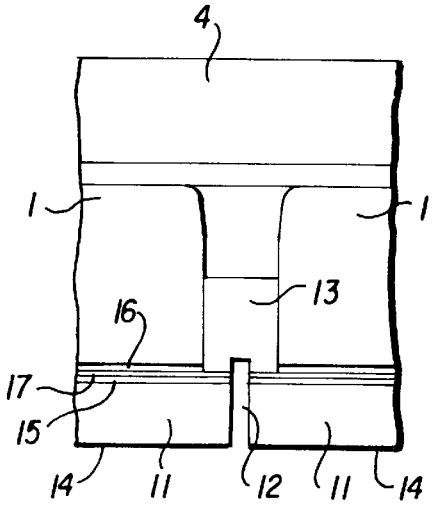
FIG. 4 shows an incompletely represented top view of the surface shell of the second working example in the direction of arrow X.
Figure 5:
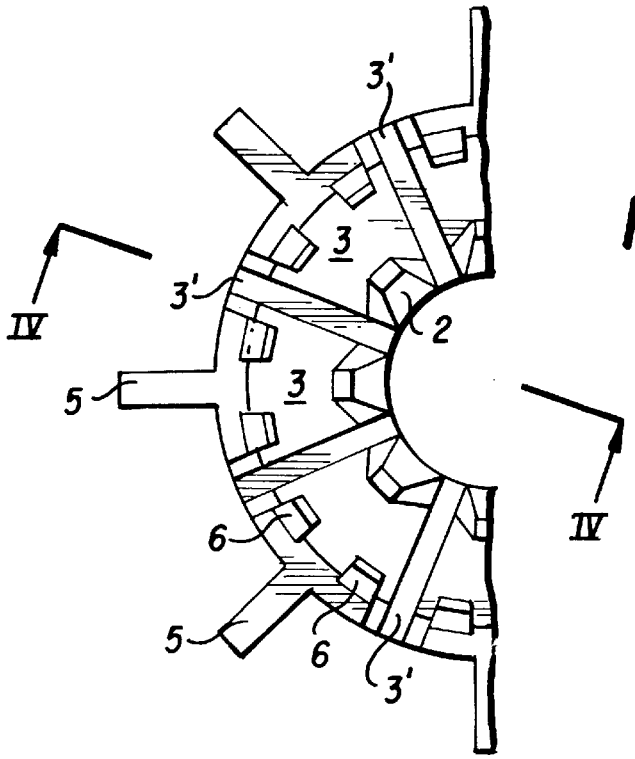
FIG. 5 shows a top view of the supporting body, which is on a reduced scale compared to the scale in FIGS. 1 to 4 and is only partially represented (one-half).
Figure 7:
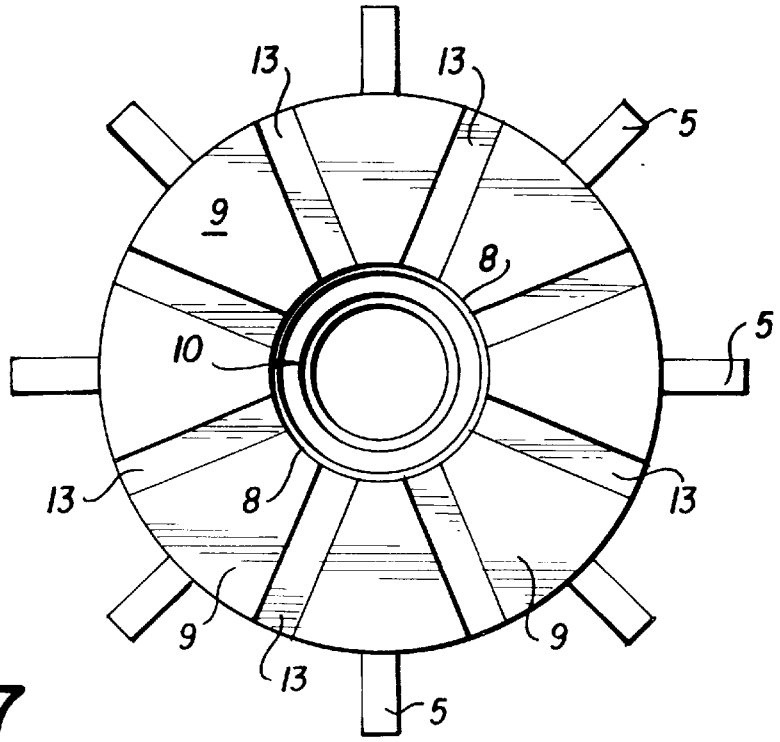
FIG. 7 shows a top view of the front of the supporting body after removing the bars between the segment supporting structures, represented on the same scale as that in FIG. 5.

If desired, the edges of the sides of the copper layer deposited on the ring wheel by vapor which are exposed in the air gaps 12 and can come into contact there with the medium surrounding the commutator, can be coated with a thin layer of silver 15 instead of copper on the ring wheel. On the copper layer can be electroplated with a silver layer 16, as FIGS. 3 and 4 show.

Moreover, the processed surface 9 of the supporting body can be covered, as a precaution, with a silver layer 16, for example, by galvanization. If the solder layer 17 is also made of silver solder, contact with the medium surrounding the commutator can no longer take place even in the air gaps 12, as especially FIG. 4 clearly shows.

Although certain presently preferred embodiments of the present invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed:

1. Process for manufacturing a flat commutator comprising a metallic supporting body with segment supporting structure connected to a carbon ring wheel having segments and a plastic hub covering a central bore of the supporting body, said process comprising the following steps:

(a) providing the supporting body with a plurality of identical grooves on a side of the supporting body which faces away from the carbon ring wheel, the grooves radially extending from an edge of the central bore to an outer edge and being spaced by an angle defined by a segmentation of the supporting body, the grooves being open to the side of the supporting body which faces away from the carbon ring wheel and having a depth smaller than a thickness of the supporting body and a width greater than an air gap present with a separation of the ring wheel into segments;

(b) forming the hub;

(c) reducing the thickness of the supporting body in an area forming a contact surface for the ring wheel until all segment supporting structures are completely electrically separated from each other through the grooves, and a plastic material filling the grooves in the contact surface is free;

(d) connecting the ring wheel to the segment supporting structures of the supporting body; and (e) separating the ring wheel into segments corresponding to the segmentation of the supporting body.

2. Process according to claim 1, wherein step (c) comprises turning in a lathe; and wherein said process further comprises providing a centering bush for the ring wheel that projects over the contact surface formed of plastic for covering the area of contact of the central bore.

3. Process according to claim 1, further including the step of coating the surface of the ring wheel to be connected to the segment supporting structures by vapor depositing silver, or, by first depositing copper and then depositing silver.

4. Process according to claim 1, further including the step of separating the segment supporting structures, and coating the contact surface for the ring wheel with a thin layer made of a material that is methanol resistant.

5. Process according to claim 4, further comprising soldering the ring wheel using silver solder on the segment supporting structures.

6. Process according to claim 1, further comprising providing changing elements using a punched out plate bar with tongues which are separated from each other and extend radially outward, and whose free end connects to each hook element.

7. Process according to claim 6, wherein said step of providing changing elements comprises forming, on the side of the changing elements pointing inward, at least one anchoring element that projects inward.

* * * * *

UNITED STATES PATENT AND TRADEMARK OFFICE

CERTIFICATE OF CORRECTION

PATENT NO. : 5,996,210
DATED : December 7, 1999
INVENTOR(S) : Eckhard König

It is certified that error appears in the above-identified patent and that said Letters Patent is hereby corrected as shown below:

Title page,
Item [73], Assignee, please change "Kautt & Bux Commutator GmbH Herrenbert, Germany" to -- Kirkwood Industries GmbH Herrenberg, Germany --
Item [22], PCT Filed: "Jan. 30, 1997" should be changed to -- June 21, 1996 --

Signed and Sealed this

Twenty-fifth Day of March, 2003

JAMES E. ROGAN
*Director of the United States Patent and Trademark Office*